US007640157B2

(12) United States Patent
Prakash et al.

(10) Patent No.: US 7,640,157 B2
(45) Date of Patent: Dec. 29, 2009

(54) SYSTEMS AND METHODS FOR LOW BIT RATE AUDIO CODERS

(75) Inventors: Vinod Prakash, Bangalore (IN); Sarat Chandra Vadapalli, Karnataka (IN); Anil Kumar, Karnataka (IN); Preethi Konda, Karnataka (IN)

(73) Assignee: Ittiam Systems (P) Ltd., Bangalore, Karnataka (IN)

( * ) Notice: Subject to any disclaimer, the term of this patent is extended or adjusted under 35 U.S.C. 154(b) by 768 days.

(21) Appl. No.: 10/774,211

(22) Filed: Feb. 6, 2004

(65) Prior Publication Data

US 2005/0071027 A1 Mar. 31, 2005

Related U.S. Application Data

(60) Provisional application No. 60/506,300, filed on Sep. 26, 2003.

(51) Int. Cl.
*G10L 19/00* (2006.01)

(52) U.S. Cl. ..... 704/230; 704/201; 704/203; 704/205; 704/500

(58) Field of Classification Search ..... None
See application file for complete search history.

(56) References Cited

U.S. PATENT DOCUMENTS

| | | | | |
|---|---|---|---|---|
| 6,438,525 | B1 * | 8/2002 | Park | 704/500 |
| 2003/0115041 | A1 * | 6/2003 | Chen et al. | 704/200.1 |
| 2004/0002859 | A1 * | 1/2004 | Liu et al. | 704/229 |
| 2004/0196913 | A1 * | 10/2004 | Chakravarthy et al. | 375/254 |

* cited by examiner

*Primary Examiner*—Richemond Dorvil
*Assistant Examiner*—Leonard Saint Cyr
(74) *Attorney, Agent, or Firm*—Prakash Nama; Global IP services, PLLC

(57) ABSTRACT

A technique to enhance audio quality of a quantized audio signal when a perceptual audio coder is operating at low bit rates. The perceptual audio coder uses a modified two-loop quantization technique that maintains audio quality at medium to high bit rates while eliminating artifacts at low bit rates. The perceptual audio coder saves vanishing bands by stealing bits from surviving bands to reduce artifacts at low bit rates.

19 Claims, 6 Drawing Sheets

SYSTEMS AND METHODS FOR LOW BIT RATE AUDIO CODERS

This application claims priority under 35 U.S.C. 119 to U.S. Provisional Applications No. 60/506,300 filed on Sep. 26, 2003 which is incorporated herein by reference.

TECHNICAL FIELD OF THE INVENTION

The present invention relates generally to audio processing and more particularly to systems and methods for use at low bit rates.

BACKGROUND OF THE INVENTION

In the present state of the art, audio coders for use in coding signals representative of, for example, speech and music, for purposes of storage or transmission, perceptual models based on the characteristics of the human auditory system are typically employed to reduce the number of bits required to code a given signal. In particular, by taking such characteristics into account, "transparent" coding (i.e., coding having no perceptible loss of quality) can be achieved with significantly fewer bits than would otherwise be necessary.

In such coders the signal to be coded is first partitioned into individual frames with each frame comprising a small time slice of the signal, such as, for example, a time slice of approximately twenty milliseconds. Then, the signal for the given frame is transformed into the frequency domain, typically with use of a filter bank. The resulting spectral lines may then be quantized and coded.

In particular, the quantizer which is used in a perceptual audio coder to quantize the spectral coefficients is advantageously controlled by a psychoacoustic model (i.e., a model based on the performance of the human auditory system) to determine masking thresholds (distortionless thresholds) for groups of neighboring spectral lines referred to as one scale factor band. The psychoacoustic model gives a set of thresholds that indicate the levels of Just Noticeable Distortion (JND), if the quantization noise introduced by the coder is above this level then it is audible. As long as the Signal to (quantization) Noise Ratio (SNR) of the spectral bands are higher than the Signal to Mask Ratio (SMR) the quantization noise cannot be perceived. The spectral lines in these scale factor bands are then non-uniformly quantized and noiselessly coded (Huffman coding) to produce a compressed bit stream. The Quantizer uses different values of step sizes for different scale factor bands depending on the distortion thresholds set by a psychoacoustic block.

The parameter controlling the compression ratios achieved by the encoder is externally decided by a bit rate parameter, which is the data rate of an output bit stream. Depending on the mode of operation, the data rate per frame can be variable or constant or can average around a constant bit rate. For applications involving streaming at low bit rates the preferred mode of operation is one of constant bit rate.

In one conventional method, quantization is carried out in two loops in order to satisfy perceptual and bit rate criteria. Prior to quantization, the incoming spectral lines are raised to a power of ¾ (Power law Quantizer) so as to provide a more consistent SNR over the range of quantizer values. The two loops, to satisfy the perceptual and the bit rate criteria, are run over the spectral lines. The two loops consist of an outer loop (distortion measure loop) and an inner loop (bit rate loop). In the inner loop, the quantization step size is adjusted in order to fit the spectral lines within a given bit rate. The above process involves modifying the step size (referred to as the global gain, as it is common for the spectrum) until the quantized spectral lines fit into a specified number of bits. The outer loop then checks for the distortion caused in the spectral lines on a band-by-band basis, and increases quantization precision for bands that have distortion above JND. The quantization precision is raised through step sizes referred to as local gains. The above iterative process repeats itself until both the bit rate and the distortion conditions are met.

The masking thresholds are usually computed frame-by-frame and slight variations of one masking threshold from one frame to the next may lead to very different bit assignments. As a result, at low bit rates some groups of spectral coefficients may appear and disappear. This spurious energy constitutes several auditory objects, which are different from the main energy and are thus clearly perceived. These kinds of artifacts, known as "birdies", are generally encountered at low bit rates.

Conventional solution to quantize with minimal distortion is to employ a low pass filter. This ensures that most of the high frequency content disappears and hence the total number of critical bands to encode comes down. This generally leads to degradation in signal quality. However, this solution does not guarantee the disappearance and appearance of the in-band frequency content, and hence does not ensure complete elimination of the birdie artifact.

SUMMARY OF THE INVENTION

The present invention enhances audio quality while operating at low bit rates without introducing birdie artifacts. In one example embodiment, a perceptual audio coder uses a modified conventional two-loop approach to maintain the audio quality at medium to high bit rates and reduces occurrence of artifacts at low bit rates during quantization. In this example embodiment, the perceptual audio coder chooses quantization steps sizes based on a user specified bit rate and a perceptual priority chart for each critical band. In addition, the critical bands are preserved so as to reduce their appearance and disappearance of the critical bands and thereby reducing the occurrence of the birdie artifacts.

In an another example embodiment, a method of quantizing an audio signal includes iteratively incrementing a quantization step size of each scale factor band of a current audio frame. The number of bits consumed in quantizing spectral lines in the scale factor bands in the current frame is then compared to a specified bit rate. Scale factor bands are then checked to determine whether they are at a vanishing point. The quantization step sizes of these scale factor bands are then frozen and quantization stops, i.e., exited from quantization, when the number of bits consumed in quantizing the spectral lines in the scale factor bands is at or below the specified bit rate.

DETAILED DESCRIPTION OF THE INVENTION

The present subject matter provides a modified two-loop quantization technique that maintains audio quality at medium to high bit rates while reducing artifacts at low bit rates. In one example embodiment, the technique saves vanishing bands by stealing bits from surviving bands to reduce the artifacts at low bit rates.

In the following detailed description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

The terms "coder" and "encoder" are used interchangeably throughout the document. Also, the terms "bands", "critical bands", and "scale factor bands" are used interchangeably throughout the document. In addition, the terms "perceptual priority chart", "perceptual relevance", and "priority chart" are used interchangeably throughout the document.

Figure 1A:
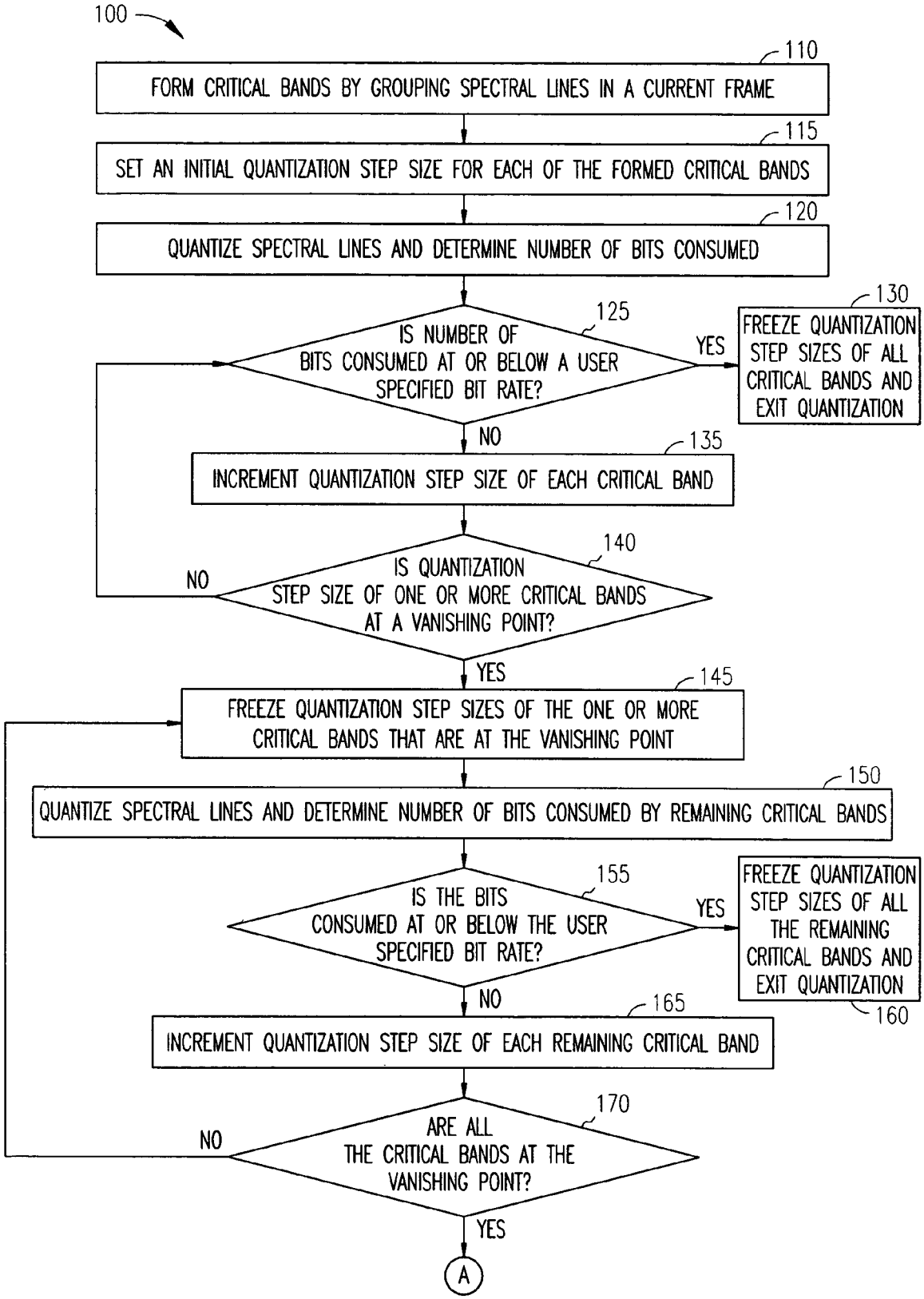
FIGS. 1A and 1B are flowcharts illustrating a two-loop quantization technique.
Figure 1B:
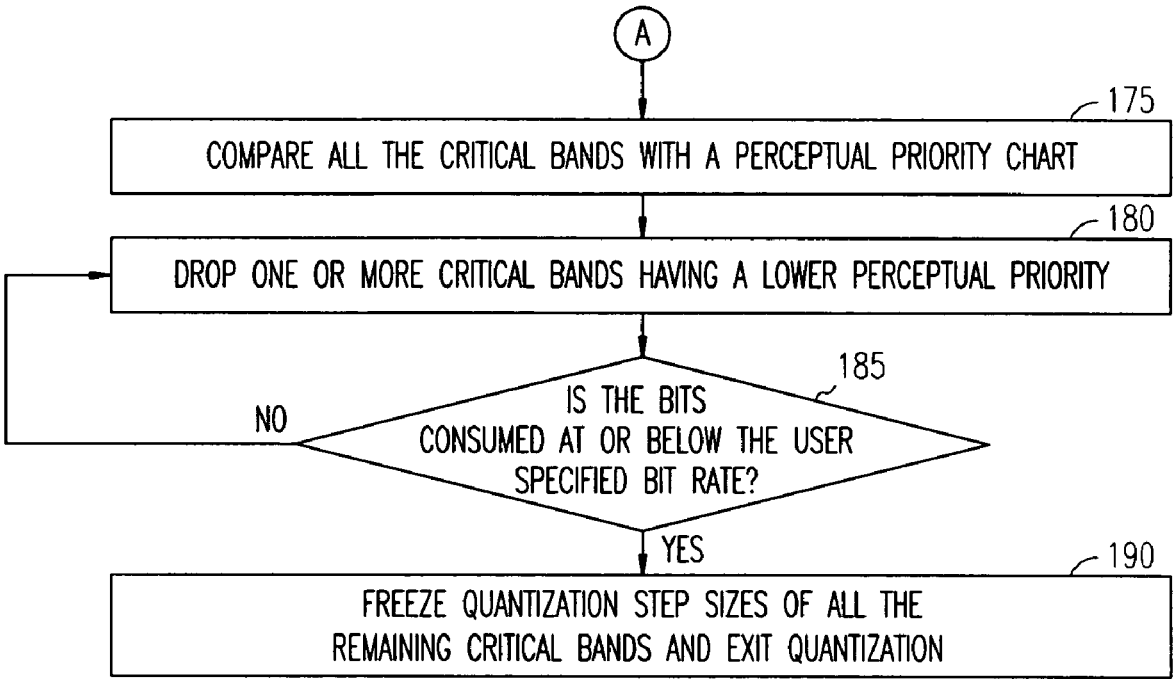

FIGS. 1A and 1B are flowcharts illustrating an example embodiment of a method 100 of a modified two-loop quantization technique according to the present subject matter. At 110, the method 100 in this example embodiment forms critical bands by grouping spectral lines in a received current frame. In some embodiments, an audio signal is partitioned into successive frames. Sets of neighboring spectral lines in each frame are then grouped to form critical bands.

At 115, an initial quantization step is assigned to each formed critical band. In some embodiments, the initial quantization step size of each formed critical band is set to a value of '0'. In either case, the initial step quantization step size is set such that none of the formed critical bands are lost.

At 120, the grouped sets of neighboring spectral lines are quantized according to the initially set quantization step sizes and number of bits consumed in each critical band is determined as a result of the quantization.

At 125, the critical bands are checked to determine whether the number of bits consumed by the critical bands to quantize the spectral lines in the critical bands is at or below a user specified bit rate. In some embodiments, the user specified bit rate can be a predetermined bit rate. In these embodiments, the number of bits consumed in each critical band is checked to determine whether they are at or below the user specified bit rate.

At 130, quantization step sizes of all the critical bands are frozen and exited from the quantization of the current frame if it is determined that the number of bits consumed is at or below the user specified bit rate at 125. At 135, quantization step size of each critical band is incremented by a predetermined quantization step size if it is determined that the number of bits consumed is above the user specified bit rate at 125. In some embodiments, the predetermined quantization step size is computed as a function of previous and current frame characteristics, such as the bit rates, the quantization step sizes, and whether the quantization step sizes are incremented up or down.

At 140, the critical bands in the current frame are checked to determine whether one or more critical bands are at a vanishing point. The vanishing point refers to a quantization value of substantially close to '0' (i.e., it is a point at which any increase in the quantization step size can result in a quantized value of '0'). Beyond this point the critical band can be lost. In some embodiments, an initial or starting quantization step size is assigned to each critical band based on a perceptual priority chart. In other embodiments, the initial quantization step size of each critical band is set to a value of '0'. The method 100 goes to act 125 and repeats acts 125-140 if it is determined that none of the critical bands are at the vanishing point at 140.

At 145, quantization step sizes of the one or more critical bands that are at the vanishing point are frozen if it is determined that the one or more critical bands are at the vanishing point at 140. At 150, the spectral lines in each of the remaining critical bands are quantized and the number of bits consumed to quantize the spectral lines in the remaining critical bands is determined.

At 155, the number of bits consumed by the spectral lines in the remaining critical bands is checked to determine whether the number of bits consumed is at or below the user specified limit. At 160, quantization step sizes of all the remaining critical bands are frozen and exited from the quantization of the current frame if it is determined that the number of bits consumed is at or below the user specified bit rate at 155. At 165, quantization step sizes of the remaining critical bands are incremented by the predetermined quantization step size if it is determined that the number of bits consumed to quantize the spectral lines in the remaining critical bands are above the user specified bit rate at 155.

At 170, the remaining critical bands are checked to determine whether all the critical bands are at the vanishing point. At 170, the method 100 goes to act 145 and repeats acts 145-170 if it is determined that not all the remaining critical bands are at the vanishing point, i.e., one or more of the remaining critical bands are at the vanishing point.

At 175, the remaining critical bands are compared with a perceptual priority chart if it is determined that all the critical bands are at the vanishing point at 170. At 180, one or more of the critical bands having a low perceptual priority are dropped as a function of the comparison at 175. In these embodiments, the one or more critical bands that do not affect quality of the audio signal, based on a perceptual relevance, are dropped during quantization.

At 185, the method 100 again checks to determine whether the number of bits consumed to quantize the spectral lines in the remaining critical bands is at or below the user specified bit rate. The method 100 goes to act 180 and repeats acts 180-185 if it is determined that the number of bits consumed is above the user specified bit rate at 185. At 190, quantization step sizes of all the remaining critical bands are frozen and exited from the quantization of the current frame if it is determined that the number of bits consumed is at or below the user specified bit rate at 185.

Figure 2A:
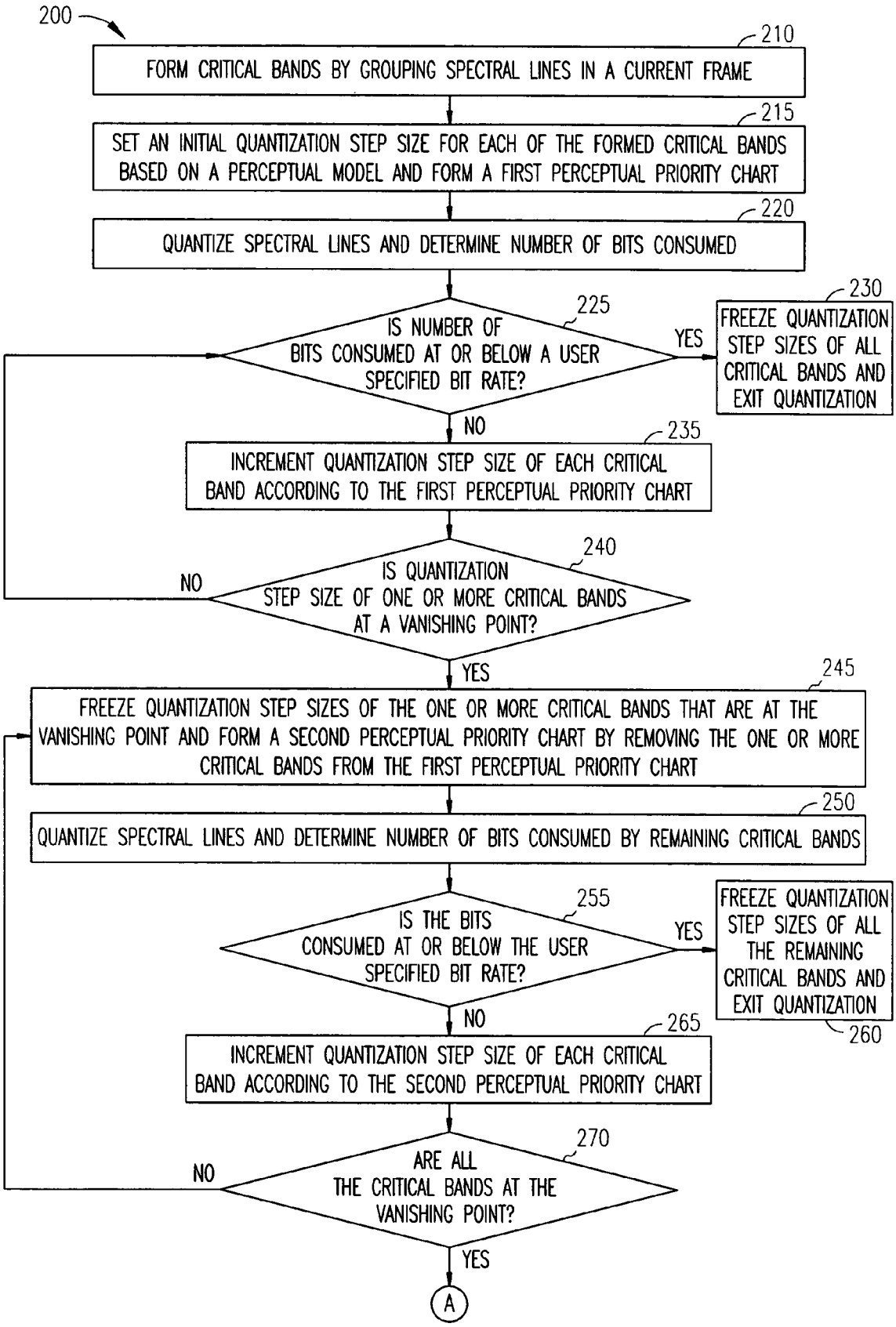
FIGS. 2A and 2B are flowcharts illustrating a two-loop quantization technique using a psychoacoustic model.
Figure 2B:
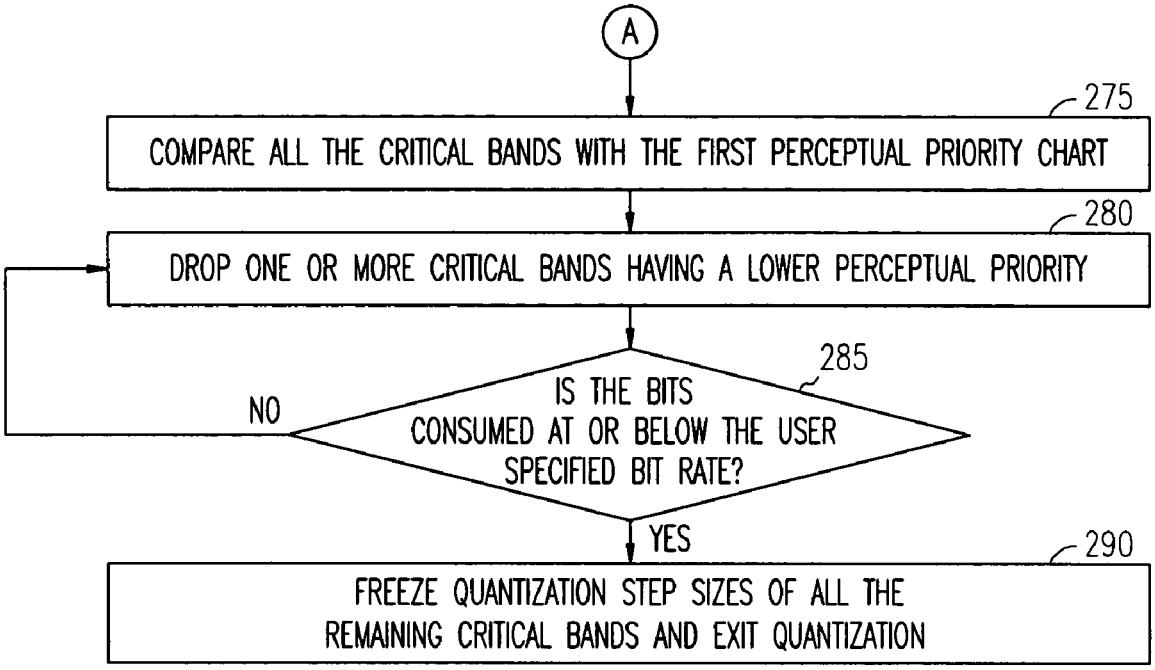

FIGS. 2A and 2B are flowcharts illustrating an example embodiment of a method 200 of a modified two-loop quantization technique using a psychoacoustic model according to the present subject matter. The method 200 is similar to method 100 except that the method 200 includes modified acts 215, 235, 245, 265, and 275 based on the use of the psychoacoustic model.

At 215, in the method 200 and as shown in FIG. 2, quantization step sizes for the critical bands are set based on a perceptual model and a first perceptual priority chart is formed using the set critical bands. At 235, quantization step sizes for the critical bands are incremented based on the formed first perceptual priority chart if it is determined that the number of bits consumed by the spectral lines in the critical bands during quantization is above the user specified bit rate at 225.

At 245, quantization step sizes of the one or more critical bands that are at the vanishing point are frozen and a second perceptual priority chart is formed by removing the one or more critical bands, that are at the vanishing point, from the first perceptual priority chart if it is determined that the quantization step sizes of the one or more critical bands are at the vanishing point at 240. At 265, quantization step size of each remaining critical band is incremented according to the formed second perceptual priority chart if it is determined that the number of bits consumed by the spectral lines in the remaining critical bands during quantization is above the user specified bit rate at 255. At 275, the remaining critical bands are compared with the first perceptual priority chart if it is determined that the quantization step sizes in all the remaining critical bands are at the vanishing point at 270.

Although the above methods 100 and 200 include acts that are arranged serially in the exemplary embodiments, other embodiments of the present subject matter may execute two or more blocks in parallel, using multiple processors or a single processor organized as two or more virtual machines or sub-processors. Moreover, still other embodiments may implement the blocks as two or more specific interconnected hardware modules with related control and data signals communicated between and through the modules, or as portions of an application-specific integrated circuit. Thus, the above exemplary process flow diagrams are applicable to software, firmware, and/or hardware implementations.

Figure 3:
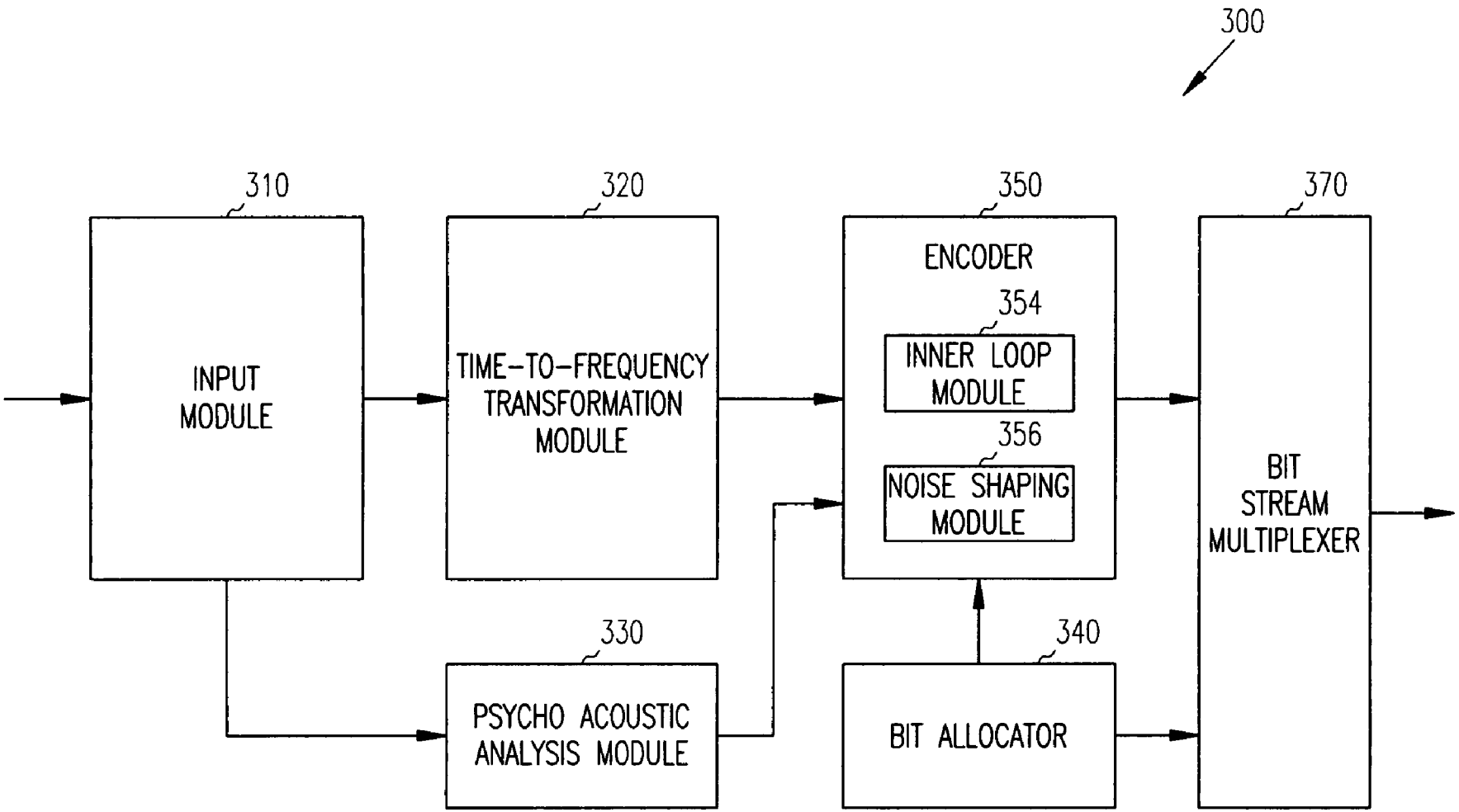
FIG. 3 is a block diagram illustrating an example perceptual audio coder.

Referring now to FIG. 3, there is illustrated an example embodiment of an audio coder 300 according to the present subject matter. The audio coder 300 includes an input module 310, a time-to-frequency transformation module 320, a psychoacoustic analysis module 330, and a bit allocator 340. The audio coder 300 further includes an encoder 350 coupled to the time-to-frequency transformation module 320 and the psycho acoustic analysis module 330. As shown in FIG. 3, the encoder 350 includes an inner loop module 354 and an outer loop module 356. Further, the audio coder 300 shown in FIG. 3, includes a bit stream multiplexer 370 coupled to the encoder 350 and the bit allocator 340.

In operation, in one example embodiment, the input module 310 receives an audio signal representative of, for example, speech and music, for purposes of storage or transmission. Perceptual models are based on characteristics of the human auditory system typically employed to reduce the number of bits required to code a given signal. In particular, by taking such characteristics into account, "transparent" coding (i.e., coding having no perceptible loss of quality) can be achieved with significantly fewer bits than would otherwise be necessary. The input module 310 in such cases partitions the received audio signal into individual frames, with each frame comprising a small time slice of the signal, such as, for example, a time slice of approximately twenty milliseconds.

The time-to-frequency transformation module 320 then receives each frame and transforms into the frequency domain, typically with the use of a filter bank, including spectral lines/coefficients. Further, the time-to-frequency module 320 forms critical bands by grouping neighboring spectral lines, based on critical bands of hearing, within each frame.

The psychoacoustic module 330 then receives the audio signal from the input module 310 and determines the effects of the psychoacoustic model. The bit allocator 340 then estimates the bit demand based (i.e., the number of bits requested by the encoder 350 to code a given frame) based on the determined psychoacoustic model. The bit demand typically varies, having a large range, from frame to frame. The bit allocator 340 then allocates number of bits that can be given to the encoder 350 based on a predetermined bit rate to code the frame.

The inner loop module 354 then determines whether the number of bits consumed by the spectral lines in the critical bands in the current frame during quantization is at or below a user specified bit rate. The inner loop module 354 freezes quantization step sizes in all the critical bands when the number of bits consumed is at or below the user specified bit rate.

The outer loop module 356 increments quantization step sizes of the critical bands by a predetermined quantization step size when the number of bits consumed is above the user specified bit rate. The outer loop module 356 then determines whether the quantization step sizes in one or more critical bands are at a vanishing point. The outer loop module 356 freezes the quantization step sizes in the one or more critical bands when the quantization step sizes in the one or more critical bands are at the vanishing point.

The outer loop module 356 quantizes spectral lines of remaining critical bands that are not at the vanishing point. The inner loop module 354 then determines whether number of bits consumed by the spectral lines in the remaining critical bands during quantization is at or below the user specified bit rate. The outer loop module 356 then freezes quantization step sizes in all the remaining critical bands and exits the quantization of the current frame when the number of bits consumed is at or below the user specified bit rate.

The outer loop module 356 increments quantization step sizes of the remaining critical bands by the predetermined quantization step size. The outer loop module 356 then determines whether the remaining critical bands are at the vanishing point.

The outer loop module 356 then increments quantization step sizes of all the critical bands and repeats the above-described functions until the user specified bit rate is met when the quantization step sizes of all the critical bands are not at the vanishing point. The outer loop module 356 compares the critical bands with a perceptual priority chart when the quantization step sizes of all the critical bands are at the vanishing point. The outer loop module 356 then drops the one or more critical bands having a lower perceptual quality as a function of the comparison. The inner loop module 354 then determines whether the number of bits consumed by the spectral lines during quantization in the remaining critical bands is at or below the user specified bit rate in the current frame. The outer loop module 356 then freezes the quantization step sizes of all the remaining critical bands when the number of bits consumed by the remaining critical bands is at or below the user specified bit rate. The outer loop module 356 drops one or more critical bands until the user specified bit rate is met when the number of bits consumed by the remaining critical bands are above the user specified bit rate. The operation of the encoder 350 is explained in more detail with reference to FIGS. 1 and 2.

Various embodiments of the present invention can be implemented in software, which may be run in the environment shown in FIG. 4 (to be described below) or in any other suitable computing environment. The embodiments of the present invention are operable in a number of general-purpose or special-purpose computing environments. Some computing environments include personal computers, general-purpose computers, server computers, hand-held devices (including, but not limited to, telephones and personal digital assistants of all types), laptop devices, multi-processors, microprocessors, set-top boxes, programmable consumer electronics, network computers, minicomputers, mainframe computers, distributed computing environments and the like to execute code stored on a computer-readable medium. The embodiments of the present invention may be implemented in part or in whole as machine-executable instructions, such as program modules that are executed by a computer. Generally, program modules include routines, programs, objects, components, data structures, and the like to perform particular tasks or to implement particular abstract data types. In a distributed computing environment, program modules may be located in local or remote storage devices.

Figure 4:
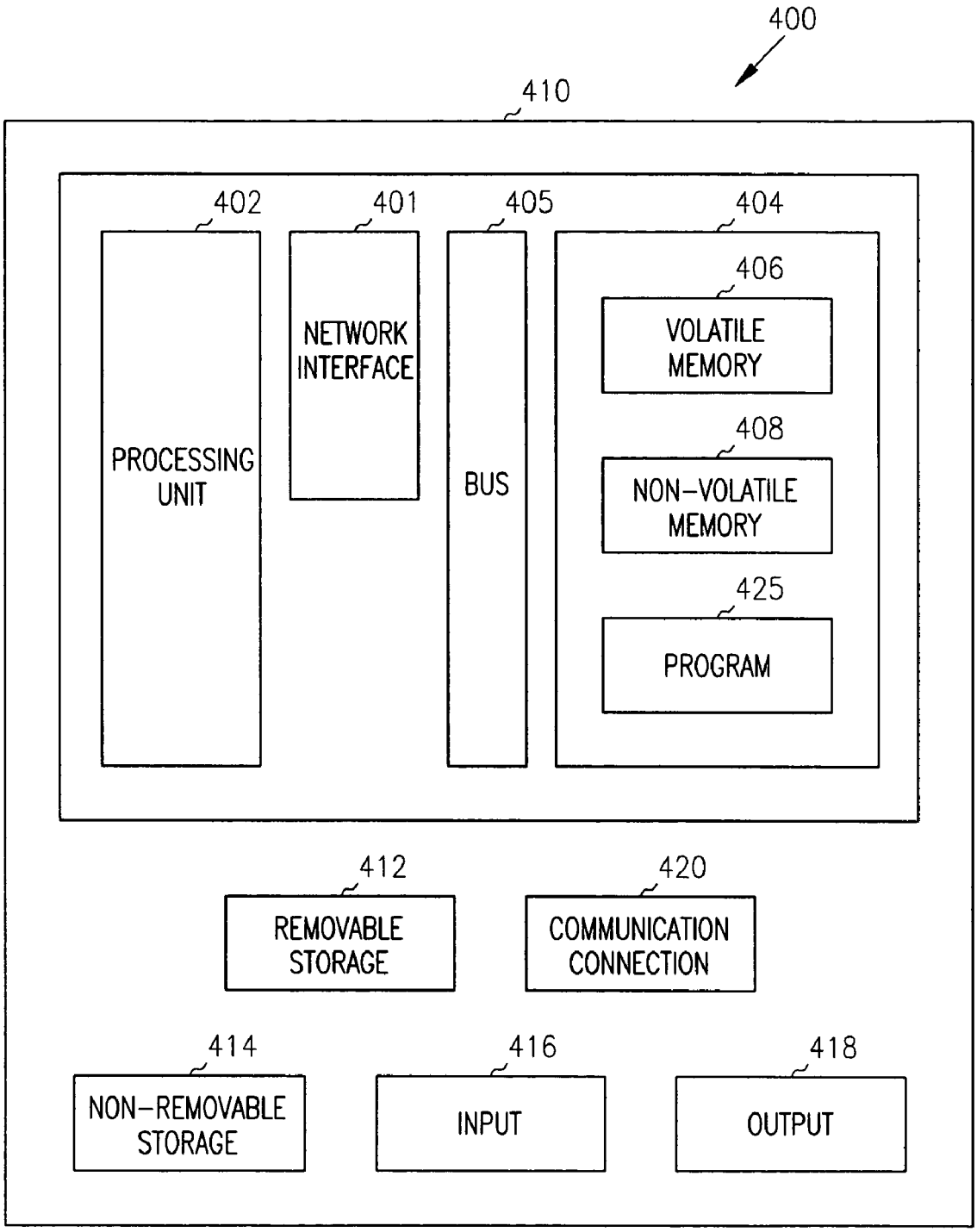
FIG. 4 is an example of a suitable computing environment for implementing embodiments of the present invention.

FIG. 4 shows an example of a suitable computing system environment for implementing embodiments of the present invention. FIG. 4 and the following discussion are intended to provide a brief, general description of a suitable computing environment in which certain embodiments of the inventive concepts contained herein may be implemented.

A general computing device, in the form of a computer 410, may include a processing unit 402, memory 404, removable storage 412, and non-removable storage 414. Computer 410 additionally includes a bus 405 and a network interface (NI) 401.

Computer 410 may include or have access to a computing environment that includes one or more input elements 416, one or more output elements 418, and one or more communication connections 420 such as a network interface card or a USB connection. The computer 410 may operate in a networked environment using the communication connection 420 to connect to one or more remote computers. A remote computer may include a personal computer, server, router, network PC, a peer device or other network node, and/or the like. The communication connection may include a Local Area Network (LAN), a Wide Area Network (WAN), and/or other networks.

The memory 404 may include volatile memory 406 and non-volatile memory 408. A variety of computer-readable media may be stored in and accessed from the memory elements of computer 410, such as volatile memory 406 and non-volatile memory 408, removable storage 412 and non-removable storage 414. Computer memory elements can include any suitable memory device(s) for storing data and machine-readable instructions, such as read only memory (ROM), random access memory (RAM), erasable programmable read only memory (EPROM), electrically erasable programmable read only memory (EEPROM), hard drive, removable media drive for handling compact disks (CDs), digital video disks (DVDs), diskettes, magnetic tape cartridges, memory cards, Memory Sticks™, and the like; chemical storage; biological storage; and other types of data storage.

"Processor" or "processing unit," as used herein, means any type of computational circuit, such as, but not limited to, a microprocessor, a microcontroller, a complex instruction set computing (CISC) microprocessor, a reduced instruction set computing (RISC) microprocessor, a very long instruction word (VLIW) microprocessor, explicitly parallel instruction computing (EPIC) microprocessor, a graphics processor, a digital signal processor, or any other type of processor or processing circuit. The term also includes embedded controllers, such as generic or programmable logic devices or arrays, application specific integrated circuits, single-chip computers, smart cards, and the like.

Embodiments of the present invention may be implemented in conjunction with program modules, including functions, procedures, data structures, application programs, etc., for performing tasks, or defining abstract data types or low-level hardware contexts.

Machine-readable instructions stored on any of the above-mentioned storage media are executable by the processing unit 402 of the computer 410. For example, a computer program 425 may comprise machine-readable instructions capable of enhancing audio quality of an audio signal when encoding at low bit rates according to the teachings and herein described embodiments of the present invention. In one embodiment, the computer program 425 may be included on a CD-ROM and loaded from the CD-ROM to a hard drive in non-volatile memory 408. The machine-readable instructions cause the computer 410 to encode an audio signal by using a modified two-loop approach that ensures maintenance of audio quality at medium to high bit rates and avoid artifacts at low bit rates according to some embodiments of the present invention.

The above description is intended to be illustrative, and not restrictive. Many other embodiments will be apparent to those skilled in the art. The scope of the invention should therefore be determined by the appended claims, along with the full scope of equivalents to which such claims are entitled.

The invention claimed is:

1. A method for quantizing an audio signal in an audio coder, the method comprising:

partitioning an audio signal into a sequence of successive frames;

initializing a quantization step size for each scale factor band of a current frame in the audio signal;

quantizing each scale factor band of the current frame with the initialized quantization step size;

determining quantized scale factor bands that are at a vanishing point, wherein the vanishing point is a point where at least the peak value of a spectral coefficient among spectral coefficients in each quantized scale factor band remains non-zero;

freezing the quantization step size for the determined scale factor bands that are at the vanishing point;

comparing the number of bits consumed in coding spectral lines in all scale factor bands in the current frame at the quantization step size to a specified bit rate;

if the number of bits consumed is greater than the specified bit-rate, incrementing the quantization step size for quantizing scale factor bands of the current frame that are not at the vanishing point and repeating the steps of quantizing, determining, freezing, and comparing wherein a maximum value of the incremented quantization step size for quantizing a scale factor band is the value beyond which the peak spectral coefficient value among the spectral coefficients in that scale factor band becomes zero; and if the number of bits consumed is not greater than the specified bit rate, exiting the quantization loop for the current frame.

2. The method of claim 1, further comprising:

grouping sets of spectral lines to form the scale factor bands in the current frame;

assigning an initial quantization step size to each scale factor band in the current frame; and quantizing the sets of spectral lines in each scale factor band.

3. A method for quantizing an audio signal in an audio coder comprising:

partitioning an audio signal into a sequence of successive frames;

initializing a quantization step size for each scale factor band of a current frame in the audio signal;

quantizing each scale factor band of the current frame with the initialized quantization step size;

determining whether the number of bits consumed in quantizing spectral lines in all scale factor bands in a the current frame is at or below a user specified bit rate;

if so, freezing quantization step sizes in all the scale factor bands and exiting the quantization of the current frame;

if not, incrementing quantization step size for quantizing scale factor bands of the current frame by a predetermined quantization step size;

determining whether the quantized scale factor bands are at a vanishing point, wherein the vanishing point is a point where at least the peak value of a spectral coefficient among spectral coefficients in each quantized scale factor band remains non-zero; and if not, repeating the above steps, wherein a maximum value of the incremented quantization step size for quantizing a scale factor band is the value beyond which the peak spectral coefficient value among the spectral coefficients in that scale factor band becomes zero.

4. The method of claim 3, further comprising:

if so, freezing the quantization step sizes of the one or more scale factor bands that are at the vanishing point;

quantizing the spectral lines of remaining scale factor bands in the current frame that are not at the vanishing point;

determining whether a number of bits consumed in quantizing all the spectral lines of the remaining scale factor bands is at or below the user specified bit rate;

if so, freezing the quantization step sizes in all the remaining scale factor bands and exiting the quantization of the current frame;

if not, incrementing quantization step size of each remaining scale factor band by the predetermined quantization step size;

determining whether the quantization step sizes in one or more of the remaining scale factor bands are at the vanishing point; and if not, repeating the above steps of determining whether a number of bits, freezing, incrementing and determining whether the quantization step sizes.

5. The method of claim 4, further comprising:

if so, comparing the remaining scale factor bands with a perceptual priority chart;

dropping one or more of the remaining scale factor bands as a function of the comparison;

determining whether the number of bits consumed by the remaining scale factor bands is at or below the user specified bit rate in the current frame;

if so, freezing the quantization step sizes in all the remaining scale factor bands and exiting the quantization of the current frame; and if not, repeating the above steps of dropping one or more additional scale factor bands as a function of the comparison until the number of bits consumed by the remaining scale factor bands is at or below the user specified bit rate.

6. The method of claim 3, further comprising:

grouping sets of spectral lines to form the scale factor bands in the current frame;

assigning an initial quantization step size to each scale factor band in the current frame; and quantizing the sets of spectral lines in each scale factor band and determining the number of bits consumed in each scale factor band based on the quantization.

7. A method for quantizing spectral information in an audio encoder comprising:

partitioning an audio signal into a sequence of successive frames;

assigning an initial quantization step size to each scale factor band in a current frame as a function of a priority chart generated based on a perceptual model;

forming a first perceptual priority chart for the assigned scale factor bands;

quantizing each scale factor band of the current frame with the initialized quantization step size;

determining whether a the number of bits consumed in quantizing spectral lines in the quantized scale factor bands in the current frame is at or below a user specified bit rate;

if so, freezing the quantization step sizes in all the scale factor bands and exiting the quantization of the current frame;

if not, incrementing the quantization step size for quantizing scale factor bands of the current frame based on the first perceptual priority chart;

determining whether the one or more scale factor bands are at a vanishing point, wherein the vanishing point is a point where at least the peak value of a spectral coefficient among spectral coefficients in each quantized scale factor band remains non-zero; and if not, repeating the above steps, wherein a maximum value of the incremented quantization step size for quantizing a scale factor band is the value beyond which the peak spectral coefficient value among the spectral coefficients in that scale factor band becomes zero.

8. The method of claim 7, further comprising:

if so, freezing the quantization step sizes of the one or more scale factor bands that are at the vanishing point;

forming a second perceptual priority chart by removing the one or more scale factor bands that are at the vanishing point from the first perceptual priority chart;

quantizing spectral lines of remaining scale factor bands that are not at the vanishing point and determining a number of bits consumed in the remaining scale factor bands based on the quantization;

determining whether the number of bits consumed in quantizing all spectral lines of the remaining scale factor bands is at or below the user specified bit rate;

if so, freezing the quantization step sizes in all the remaining scale factor bands and exiting the quantization of the current frame;

if not, incrementing quantization step size of each remaining scale factor band based on the second perceptual priority chart;

determining whether all the remaining scale factor bands are at the vanishing point; and if not, repeating the above steps of determining whether the number of bits consumed, freezing the quantization step sizes, incrementing quantization step size, and determining whether all the remaining scale factor bands.

9. The method of claim 8, further comprising:

if so, comparing the remaining scale factor bands with the first perceptual priority chart;

dropping one or more of the remaining scale factor bands having lower perceptual priority as a function of the comparison;

determining whether the number of bits consumed by the remaining scale factor bands is at or below the user specified bit rate in the current frame;

if so, freezing the quantization step sizes of all the remaining scale factor bands and exiting the quantization of the current frame; and if not, repeating the above steps of dropping one or more additional scale factor bands as a function of the comparison until the number of bits consumed by the remaining scale factor bands is at or below the user specified bit rate.

10. An article comprising:

a storage medium having instructions that, when executed by a computing platform, result in execution of a method comprising;

partitioning an audio signal into a sequence of successive frames;

initializing a quantization step size for each scale factor band of a current frame in the audio signal;

quantizing each scale factor band of the current frame with the initialized quantization step size;

determining whether the number of bits consumed in quantizing spectral lines in all scale factor bands in the current frame is at or below a user specified bit rate;

if so, freezing quantization step sizes in all the scale factor bands and exiting the quantization of the current frame;

if not, incrementing quantization step size for quantizing scale factor bands of the current frame by a predetermined quantization step size;

determining whether one or more quantized scale factor bands are at a vanishing point, wherein the vanishing point is a point where at least the peak value of a spectral coefficient among spectral coefficients in each quantized scale factor band remains non-zero; and if not, repeating the above steps, wherein a maximum value of the incremented quantization step size for quantizing a scale factor band is the value beyond which the peak spectral coefficient value among the spectral coefficients in that scale factor band becomes zero.

11. The article of claim 10, further comprising:

if so, freezing the quantization step sizes of the one or more scale factor bands that are at the vanishing point;

quantizing spectral lines of remaining scale factor bands in the current frame that are not at the vanishing point;

determining whether a number of bits consumed in quantizing all the spectral lines of the remaining scale factor bands is at or below the user specified bit rate;

if so, freezing the quantization step sizes in all the remaining scale factor bands and exiting the quantization of the current frame;

if not, incrementing quantization step size of each remaining scale factor band by the predetermined quantization step size;

determining whether all the remaining scale factor bands are at the vanishing point; and if not, repeating the above steps of determining whether the number of bits consumed, freezing the quantization step sizes, incrementing quantization step size, and determining whether all the remaining scale factor bands.

12. The article of claim 11, further comprising:

if so, comparing the scale factor bands with a perceptual priority chart;

dropping one or more of the scale factor bands as a function of the comparison;

determining whether the number of bits consumed by the remaining scale factor bands is at or below the user specified bit rate in the current frame;

if so, freezing the quantization step sizes of all the remaining scale factor bands and exiting the quantization of the current frame; and if not, repeating the above steps of dropping additional scale factor bands as a function of the comparison until the number of bits consumed by the remaining scale factor bands is at or below the user specified bit rate.

13. An audio coder comprising:

an input module partitions an audio signal into a sequence of successive frames;

a time-to-frequency transformation module obtains the spectral lines in each frame and forms critical bands by grouping sets of neighboring spectral lines; and an encoder coupled to the time-to-frequency module, wherein the encoder further comprises:

an inner loop module determines whether a number of bits consumed in each critical band is at or below a user specified bit rate in a current frame, wherein the inner loop module freezes quantization step sizes in all the critical bands when the number of bits consumed is at or below the user specified bit rate; and an outer loop module increments quantization step sizes for quantizing each critical band by a predetermined quantization step size when the number of bits consumed is above the user specified bit rate, wherein a maximum value of the incremented quantization step size for quantizing a critical band is the value beyond which the peak spectral coefficient value among the spectral coefficients in that critical band becomes zero, and determines whether the one or more quantized critical bands are at a vanishing point, wherein the vanishing point is a point where at least the peak value of a spectral coefficient among spectral coefficients in each quantized critical band remains non-zero, and wherein the outer loop module freezes the quantization step sizes of the one or more critical bands that are at the vanishing point.

14. The audio coder of claim 13, wherein the outer loop module quantizes spectral lines of remaining critical bands that are not at the vanishing point, wherein the inner loop module determines whether a number of bits consumed by the remaining critical bands is at or below the user specified bit rate, wherein the outer loop module freezes the quantization step sizes in all the remaining critical bands and exits quantization of the current frame, wherein the outer loop module increments quantization step sizes of the remaining critical bands by the predetermined quantization step size, wherein the outer loop module determines whether the remaining critical bands are at the vanishing point, and wherein the outer loop module increments quantization step sizes until the user specified bit rate is met when none of the remaining critical bands are not at the vanishing point.

15. The audio coder of claim 14, wherein the outer loop module compares the remaining critical bands with a perceptual priority chart when all the critical bands are at the vanishing point, wherein the outer loop module drops the one or more of the critical bands having a lower perceptual quality as a function of the comparison, wherein the inner loop module determines whether the number of bits consumed by the spectral lines in the remaining critical bands is at or below the user specified bit rate in the current frame, wherein the outer loop module freezes the quantization step sizes of all the remaining critical bands when the number of bits consumed by the remaining critical bands is at or below the user specified bit rate and exits the quantization of the current frame, and wherein the outer loop module drops one or more critical bands until the user specified bit rate is met when the number of bits consumed by the remaining critical bands are above the user specified bit rate.

16. A system comprising:

a bus;

a processor coupled to the bus;

a memory coupled to the processor;

a network interface coupled to the processor and the memory; and an audio coder coupled to the network interface and the processor, wherein the audio coder further comprises:

an input module partitions an audio signal into a sequence of successive frames;

a time-to-frequency transformation module obtains the spectral lines in each frame and forms critical bands by grouping sets of neighboring spectral lines; and an encoder coupled to the time-to-frequency module, wherein the encoder further comprises:

an inner loop module determines whether a number of bits consumed in quantizing spectral lines in each scale factor band is at or below a user specified bit rate in a current frame, wherein the inner loop module freezes quantization step sizes in all the critical bands when the number of bits consumed is at or below the user specified bit rate; and an outer loop module increments quantization step sizes for quantizing each critical band by a predetermined quantization step size when the number of bits consumed is above the user specified bit rate, wherein a maximum value of the incremented quantization step size for quantizing a critical band is the value beyond which the peak spectral coefficient value among the spectral coefficients in that critical band becomes zero, wherein the outer loop module determines whether one or more quantized critical bands are at a vanishing point, wherein the vanishing point is a point where at least the peak value of a spectral coefficient among spectral coefficients in each quantized critical band remains non-zero, and wherein the outer loop module freezes the quantization step sizes of the one or more critical bands that are at the vanishing point.

17. The system of claim 16, wherein the outer loop module quantizes spectral lines of remaining critical bands in the current frame that are not at the vanishing point, wherein the inner loop module determines whether a number of bits consumed in quantizing the spectral lines in the remaining critical bands is at or below the user specified bit rate, wherein the outer loop module freezes the quantization step sizes in all the remaining critical bands and exits quantization of the current frame when the number of bits consumed in quantizing the critical bands is at or below the user specified bit rate, wherein the outer loop module increments quantization step sizes of the remaining critical bands by the predetermined quantization step size, wherein the outer loop module determines whether all the remaining critical bands are at the vanishing point, and wherein the outer loop module increments quantization step sizes until the user specified bit rate is met when none of the remaining critical bands are not at the vanishing point.

18. The system of claim 17, wherein the outer loop module compares the remaining critical bands with a perceptual priority chart when all the critical bands are at the vanishing point, wherein the outer loop module drops the one or more critical bands having a lower perceptual quality as a function of the comparison, wherein the inner loop module determines whether the number of bits consumed by the spectral lines in the remaining critical bands is at or below the user specified bit rate in the current frame, wherein the outer loop module freezes the quantization step sizes of all the remaining critical bands when the number of bits consumed by the remaining critical bands is at or below the user specified bit rate and exits the quantization of the current frame, and wherein the outer loop module drops one or more critical bands until the user specified bit rate is met when the number of bits consumed by the remaining critical bands are above the user specified bit rate.

19. An apparatus for encoding an audio signal in an audio coder, comprising:

means for partitioning an audio signal into a sequence of successive frames;

means for obtaining the spectral lines in each frame and forming critical bands by grouping sets of neighboring spectral lines; and means for initializing a quantization step size for each critical band of a current frame in the audio signal;

means for quantizing critical bands of the current frame with the initialized quantization step size, wherein the means for quantizing further comprises:

means for determining whether a number of bits consumed by the spectral lines in the quantized critical bands is at or below a user specified bit rate in a current frame, and freezing the quantization step sizes in all the critical bands when the number of bits consumed is at or below the user specified bit rate; and means for incrementing quantization step size of each critical band by a predetermined quantization step size when the number of bits consumed is above the user specified bit rate, wherein a maximum value of the incremented quantization step size for quantizing a critical band is the value beyond which the peak spectral coefficient value among the spectral coefficients in that critical band becomes zero, and wherein the means for incrementing quantization step size of each critical band determines whether one or more quantized critical bands are at a vanishing point, wherein the vanishing point is a point where at least the peak value of a spectral coefficient among spectral coefficients in each quantized critical band remains non-zero.

* * * * *